US009271583B2

(12) United States Patent
Guerer

(10) Patent No.: US 9,271,583 B2
(45) Date of Patent: Mar. 1, 2016

(54) BEVERAGE STORAGE CABINET

(71) Applicant: FOCUS WINE CELLARS FWC INC., Pointe Claire (CA)

(72) Inventor: Osman Guerer, Pointe Claire (CA)

(73) Assignee: FOCUS WINE CELLARS FWC INC., Pointe Claire (CA)

( * ) Notice: Subject to any disclaimer, the term of this patent is extended or adjusted under 35 U.S.C. 154(b) by 215 days.

(21) Appl. No.: 14/178,253

(22) Filed: Feb. 11, 2014

(65) Prior Publication Data

US 2015/0223617 A1 Aug. 13, 2015

(51) Int. Cl.

| | |
|---|---|
| ***F25D 23/00*** | (2006.01) |
| ***A47F 3/00*** | (2006.01) |
| ***A47F 3/04*** | (2006.01) |
| ***F21V 33/00*** | (2006.01) |
| ***F21V 7/00*** | (2006.01) |
| ***F21V 23/04*** | (2006.01) |
| ***F21V 23/00*** | (2015.01) |
| ***A47F 7/28*** | (2006.01) |
| ***A47F 11/06*** | (2006.01) |
| *F21Y 103/00* | (2006.01) |
| *F21W 131/301* | (2006.01) |

(52) U.S. Cl.

CPC ..... *A47F 3/001* (2013.01); *A47F 3/043* (2013.01); *A47F 7/28* (2013.01); *A47F 11/06* (2013.01); *F21V 7/0033* (2013.01); *F21V 23/001* (2013.01); *F21V 23/0464* (2013.01); *F21V 33/0012* (2013.01); *F21W 2131/301* (2013.01); *F21Y 2103/003* (2013.01)

(58) Field of Classification Search

CPC ..... A47F 3/04; A47F 3/0404; A47F 3/0426; A47F 3/0434; F21V 33/0044; F25D 23/00; F25D 27/00

See application file for complete search history.

(56) References Cited

U.S. PATENT DOCUMENTS

| | | | | |
|---|---|---|---|---|
| 5,787,618 | A | 8/1998 | Mullis | |
| 6,059,420 | A * | 5/2000 | Rogers | A47F 3/0434 362/223 |
| 7,254,952 | B2 | 8/2007 | Lilke | |
| 2002/0060511 | A1 * | 5/2002 | Ma | E06B 3/24 312/116 |
| 2010/0180615 | A1 * | 7/2010 | Linder | A47F 3/0434 62/248 |
| 2011/0051401 | A1 * | 3/2011 | Bauer | F21S 4/008 362/125 |
| 2012/0159968 | A1 * | 6/2012 | Doucet | F25D 31/007 62/3.6 |
| 2014/0268862 | A1 * | 9/2014 | Gooden | F25D 27/00 362/555 |
| 2015/0102710 | A1 * | 4/2015 | Hottmann | G09F 3/00 312/128 |

* cited by examiner

*Primary Examiner* — Daniel Rohrhoff

(74) *Attorney, Agent, or Firm* — Arc IP Law, PC; Joseph J. Mayo

(57) ABSTRACT

A beverage storage cabinet enclosure including a front wall surface with a one-way mirror, a front door with layered thermal glass, support bars, back wall with a full mirror, sidewalls with full mirrors or light boxes a top and bottom. The support bars support beverage containers and may include light elements. Presents an infinity effect reflection of a repeated succession of items that appear to recede rearward behind the back wall. In embodiments, the enclosure includes a controller and light sensor to adjust one or more of lights, and enhance and vary the infinity effect by brightening or dimming the lights to keep internal light intensity brighter than external light intensity.

20 Claims, 10 Drawing Sheets

BEVERAGE STORAGE CABINET

BACKGROUND OF THE INVENTION

1. Field of the Invention

One or more embodiments of the invention are related to beverage storage cabinets, specifically storage cabinets for holding beverage containers, such as wine bottles, or any other type of bottles. More particularly, but not by way of limitation, one or more embodiments of the invention describe a storage cabinet enclosure including beverage support bars with lighting elements, a front wall surface with a one-way mirror, sidewall surfaces with full mirrors or light boxes, and a back wall surface with a full mirror for presenting and enhancing an infinity effect reflection of a repeated succession of items that appear to recede rearward behind the back wall surface. Embodiments of the invention may also vary the infinity effect by one or more of varying the intensity of enclosure lights if an ambient light exterior to the enclosure is dim, or bright, to adjust the internal light intensity to remain relatively brighter than the external light to produce or enhance the infinity effect.

2. Description of the Related Art

Generally, beverage storage cabinets, such as wine cellars, include insulated walls with cooling elements that may store beverage bottles over a prolonged period of time. Many beverage storage cabinets most often include a glass door or display to view the true number of stored beverage containers. In addition, some glass doors or displays allow exterior lighting to enter that may hinder the viewing ability of one or more viewers and may hinder the prolonged storage of beverage containers by damaging the quality of the beverages. Traditionally, beverage storage cabinets, such as wine cellars, include racks to store the wine bottles and lighting that generally illuminates the cellar to view the contents of the wine cellar as a whole. Most often, distinguished beverage storage cabinets differ in their structure, material and designs.

For example, U.S. Pat. No. 7,254,952 to Lilke, entitled "Modular Wine Cellar and Wine Storage System", discloses a wine storage system including a frame and members to form a three-dimensional array of compartments in rows and columns, and cooling elements within the system for cooling the wine bottles. Lilke, however, appears to lack any teaching of a beverage storage cabinet including a one-way mirror, full mirrors opposing one another to present and enhance an infinity effect reflection of a repeated succession of items that appear to recede rearward behind a back wall surface. In addition, Lilke appears to lack any disclosure of beverage support bars with at least one light element to support beverage containers, and illuminate each beverage container. Furthermore, Lilke appears to lack any disclosure of a light sensor and controller that automatically brighten and/or dim interior lights if an ambient light exterior to the enclosure is dim and/or bright, respectively. Hence, with respect to Lilke as well as disclosed in the remaining references discussed herein, none of the references contemplate adjusting internal lighting to remain relatively brighter than external lighting to produce and/or ensure the infinity effect.

United States Patent Publication 2012/0159968 to Doucet et al., entitled "Compartmented Temperature and Humidity Controlled Modular Housing for the Storage and Preservation of Wine Bottles" discloses a temperature and humidity controlled housing to store wine bottles with front and rear temperature control chambers. Doucet et al., however, appears to lack any disclosure of a beverage storage cabinet including a one-way mirror, full mirrors opposing one another to present and enhance an infinity effect reflection of a repeated succession of items that appear to recede rearward behind a back wall surface. In addition, Doucet et al. appears to lack any disclosure of beverage support bars with at least one light element to support beverage containers, and illuminate each beverage container. Furthermore, Doucet et al. appears to lack any disclosure of a light sensor and controller that automatically dim and/or brighten interior lights if an ambient light exterior to the enclosure is dim and/or bright, respectively.

U.S. Pat. No. 5,787,618 to Mullis, entitled "Display Apparatus That Forms An Optical Illusion" appears to disclose a display device with an interior area, a one-way mirror, and a back full mirror that may display multiple images as a reflection of one or more illuminated patterns from within an enclosure that extend rearward. Mullis also appears to disclose one or more spotlights that illuminate the interior of the enclosure. Mullis, however, appears to lack any disclosure of a beverage storage cabinet including full mirrors opposing one another to present and enhance an infinity effect reflection of a repeated succession of items that appear to recede rearward behind a back wall surface. In addition, Mullis appears to lack any disclosure of beverage support bars with at least one light element to support beverage containers, and illuminate each beverage container. Mullis also does not appear to contemplate temperature or humidity control and/or recording and/or monitoring. Furthermore, Mullis appears to lack any disclosure of a light sensor and controller that automatically dim and/or brighten interior lights if an ambient light exterior to the enclosure is dim and/or bright, respectively.

For at least the limitations described above there are no known beverage storage cabinets that include a one-way mirror, a full back mirror, and full side mirrors opposing one another to present and enhance an infinity effect reflection of a repeated succession of items that appear to recede rearward behind a back wall surface Furthermore, there are no known beverage storage cabinets that include a light sensor and controller that automatically dim and/or brighten interior lights if an ambient light exterior to the enclosure is dim and/or bright, respectively, again with respect to all references discussed herein, to adjust internal lighting to remain relatively brighter than external lighting to produce and/or ensure the infinity effect.

BRIEF SUMMARY OF THE INVENTION

One or more embodiments of the invention are related to beverage storage cabinets, specifically beverage storage cabinet enclosures for holding beverage containers, such as wine bottles, and presenting and enhancing an infinity effect reflection of a repeated succession of items such as the bottles. In one or more embodiments of the invention, a beverage storage cabinet may include an enclosure that may include at least two insulation layers, a front wall surface including at least one air-tight front door, at least one storage support bar, at least two sidewall surfaces opposing or parallel to one another, a top and a bottom opposing or parallel to one another, and a back wall surface opposing or parallel to the front wall surface. In at least one embodiments, the at least one air-tight front door may include layered thermal glass, the at least one storage support bar may support at least one beverage container, such as at least one wine bottle, and the at least one support bar may include at least one light element.

In at least one embodiment, the back wall surface may couple to the at least two sidewall surfaces along vertical axes. In embodiments of the invention, the back wall surface and the two sidewall surfaces may couple with the top and bottom, and the front door may enclose an inner portion of the enclosure.

By way of one or more embodiments, the at least two sidewall surfaces may each include a full mirror opposing or parallel to one another, the front wall surface may include a one-way mirror, and the back wall surface may include a full mirror facing the front wall surface. According to embodiments of the invention, the enclosure may present an infinity effect reflection of a repeated succession of items that appear to recede rearward behind the back wall surface. In at least one embodiment of the invention, the beverage storage cabinet may visually multiply a limited number of beverage containers within the enclosure.

In embodiments of the invention, the beverage storage cabinet may include a controller that may enhance and vary the infinity effect. According to embodiments of the invention, the at least one light element may include at least one LED light strip. In one or more embodiments, the one-way mirror may be integrated in the layered thermal glass. In at least one embodiment, the beverage storage cabinet may include or hold one or more of a humidity control unit and a temperature control unit.

In embodiments of the invention, the enclosure may include internal enclosure lights internal to the enclosure on each of the two sidewall surfaces. By way of one or more embodiments, the beverage storage cabinet may include a light sensor that may be coupled with the controller to adjust the internal enclosure lights to enhance and vary the infinity effect. In one or more embodiments, the beverage storage cabinet may include a dimmer that may couple with the controller and the light sensor. In at least one embodiment, the controller may adjust the internal enclosure lights by one or more of brightening/dimming the internal enclosure lights to set or maintain internal lighting to an intensity that is relatively brighter than external lighting to ensure and/or produce the infinity effect.

According to one or more embodiments, the one-way mirror may include an electronic one-way mirror coupled with the controller. In embodiments of the invention, the dimmer and light sensor may be coupled with the controller and the electronic one-way mirror. In at least one embodiment, the electronic one-way mirror may include at least one light coupled with the light sensor, such that the controller may enhance and vary the infinity effect on the electronic one-way mirror by adjusting the at least one light by one or more of brightening and dimming the at least one light in one or more embodiment in order to maintain internal lighting relatively brighter than external lighting to ensure and/or produce the infinity effect.

By way of at least one embodiment, the beverage storage cabinet may include one or more of a power cord, a plug and a lock. In one or more embodiments, the lock may couple at least one side of the front door to one of the at least two sidewall surfaces and/or top and/or bottom surfaces. In at least one embodiment, the beverage storage cabinet may include at least one hinge, such that the front door may couple with at least one of the at least two sidewall surfaces via the at least one hinge. In at least one embodiment, the front door may couple with an area proximal to the top or bottom via the at least one hinge.

In one or more embodiments of the invention, the beverage storage cabinet may include at least one sliding coupling element, such that the front door may couple with an area proximal to the top or bottom or both the top and bottom via the at least one sliding coupling element. In one or more embodiments of the invention, the beverage storage cabinet may include one or more of a temperature recording device and a humidity recording device and/or a remote electronic monitoring system that measures the ambient temperature and humidity inside the cellar, and of the air as taken in by the condenser of the AC unit and the air blown back into the cabinet by the evaporator of the AC. When the results are outside the previously set values, a message may be sent to the manufacturer via SMS, GSM, Internet or normal phone lines. The manufacturer and/or owner of the cabinet may use the data for diagnostic and determines how to respond.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A storage cabinet with an enclosure for presenting and enhancing an infinity effect reflection of a repeated succession of items that appear to recede rearward will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

One or more embodiments of the invention are related to beverage storage cabinets, specifically beverage storage cabinet enclosures for holding beverage containers, such as wine bottles, or any other type of bottles, and presenting and enhancing an infinity effect reflection of a repeated succession of items such as the bottles.

Figure 1:
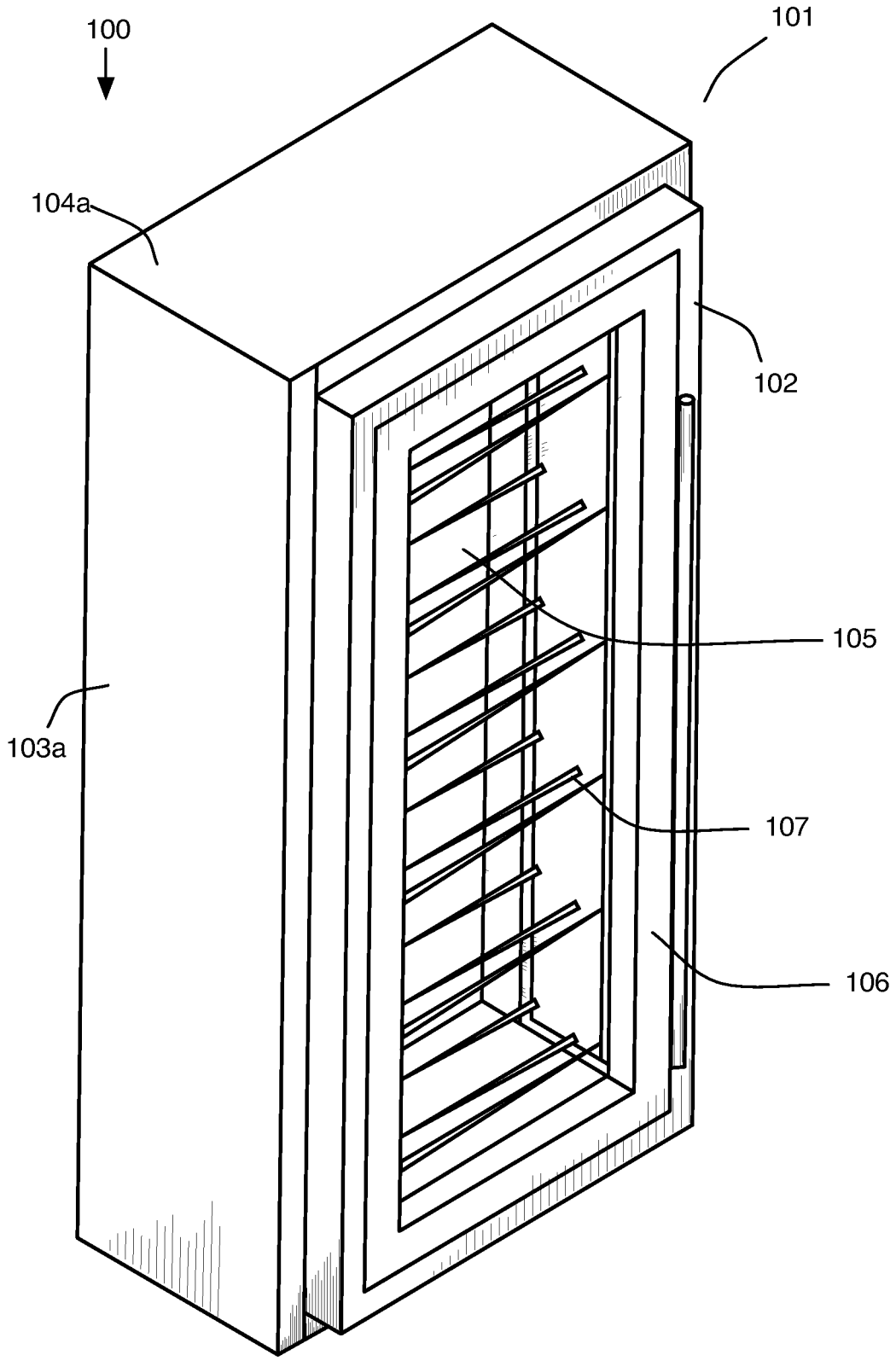
FIG. 1 shows a left upper perspective view of the beverage storage cabinet according to one to more embodiments of the invention having one door.
Figure 2:
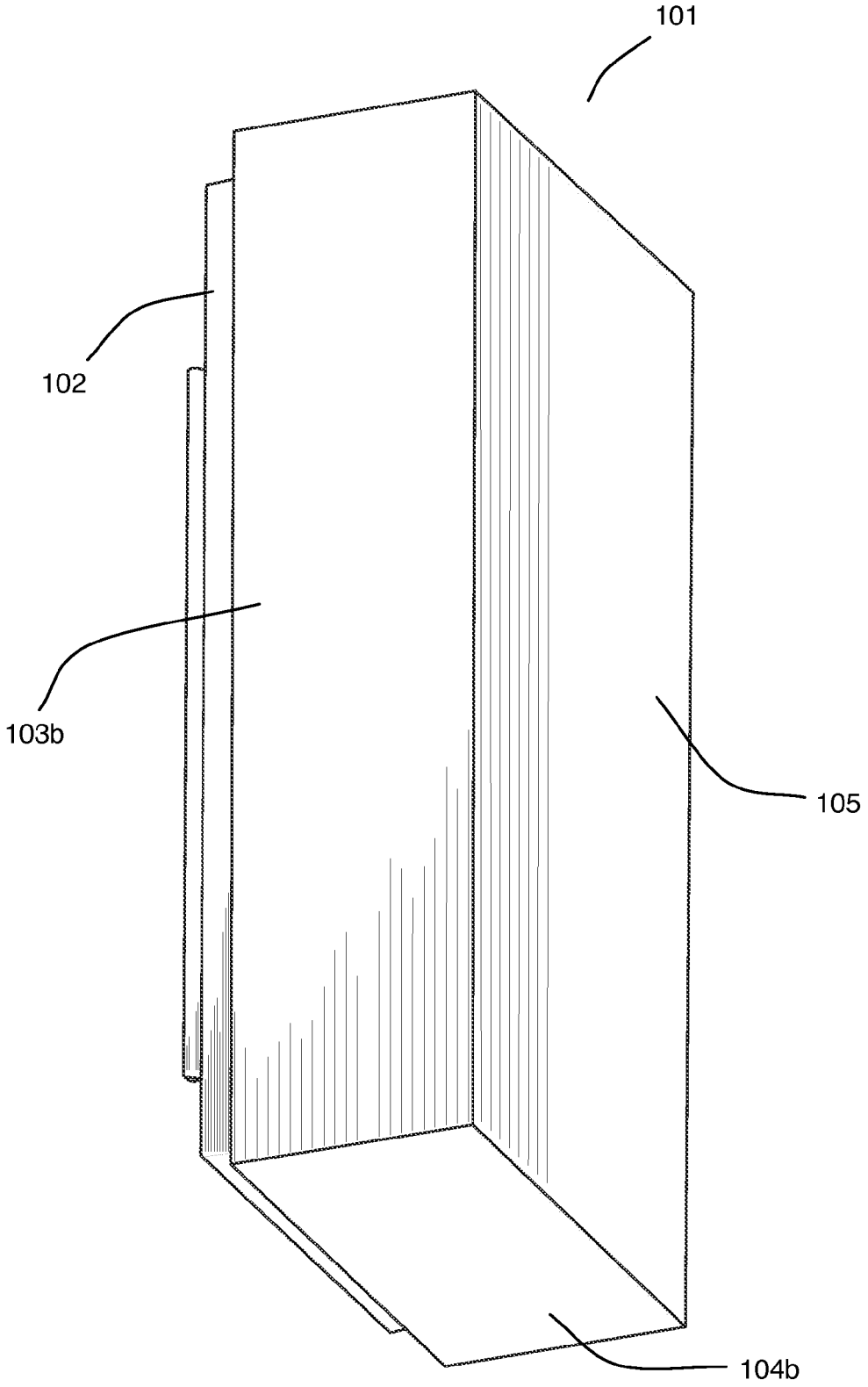
FIG. 2 shows a right lower perspective view of the beverage storage cabinet according to one or more embodiments of the invention.

FIG. 1 shows a left upper perspective view of a one-door embodiment of the beverage storage cabinet according to one to more embodiments of the invention and FIG. 2 shows a right lower perspective view of the beverage storage cabinet according to one or more embodiments of the invention. As shown in FIGS. 1-2, according to one or more embodiments of the invention, a beverage storage cabinet 100 may include an enclosure 101 that may include at least two insulation layers (not shown), a front wall surface 102 including at least one air-tight front door 106, at least one storage support bar 107, at least two sidewall surfaces opposing or parallel to one another 103*a* and 103*b*, a top 104*a* and a bottom 104*b* opposing or parallel to one another, and a back wall surface 105 opposing or parallel to the front wall surface 102. In at least one embodiments, the at least one air-tight front door 106 may include layered thermal glass. In one or more embodiments, the at least one storage support bar 107 may support at least one beverage container, such as at least one wine bottle, and the at least one support bar 107 may include at least one light element (shown in FIG. 11 and discussed below). In one or more embodiments, the at least one support bar 107 may support each item, or beverage container, from bearing against another beverage container, and may provide support at a bottom of each beverage container from bearing against the back wall surface 105, the front wall surface 102 and each of the two sidewall surfaced 103 and 103*b*.

In at least one embodiment, the back wall surface 105 may couple to the at least two sidewall surfaces, 103*a* and 103*b*, along vertical axes. In embodiments of the invention, the back wall surface 105 and the two sidewall surfaces, 103*a* and 103*b*, may couple with the top 104*a* and bottom 104*b*, and the front door 106 may enclose an inner portion of the enclosure.

By way of one or more embodiments, the at least two sidewall surfaces may each include a full mirror opposing or parallel to one another (shown in FIG. 11 and discussed below), the front wall surface 102 may include a one-way mirror (shown in FIG. 11 and discussed below), and the back wall surface 105 may include a full mirror facing the front wall surface 102 (shown in FIG. 10 and discussed below). According to embodiments of the invention, the enclosure 101 may present an infinity effect reflection of a repeated succession of items, such the beverage containers that appear to recede rearward behind the back wall surface 105, away from a viewer. In one or more embodiments of the invention, the two sidewall surfaces 103*a* and 103*b* are implemented with light boxes and provide light to the interior of the cabinet. In other embodiments of the invention, the internal walls are implemented as full mirrors, for example on the two sidewall surfaces 103*a* and 103*b* that may be parallel for example, and the full mirror on the back wall surface 105 and the one-way mirror on the front wall surface 102 are parallel to each other, the reflections of the beverage containers, or items within the beverage storage container 100, are multiplied. The images of the items within the beverage storage container 100 may be repeatedly reflected on all surfaces of the enclosure 101, back and forth, resulting in an infinite array of the items away from the reflective surfaces. In at least one embodiment, when so implemented with internal mirrors, each of the full mirrors on the two sidewall surfaces 103*a* and 103*b*, may be placed at one or more different angles, not in parallel, that may create varying effects of reflected images of the one or more beverage containers or items within the enclosure 101. The full mirror on the back wall surface 105 and the one-way mirror on the front wall surface 102 may be placed parallel to one another or at one or more different angles other than parallel to produce the infinity effect that may include varying effects of reflected images of the one or more beverage containers or items within the enclosure 101. In one or more embodiments any of the mirrors may be implemented as one-way mirrors so that the cabinet contents and infinity effect may be observed from any outer surface, whether back, or sides in addition to the front view detailed herein.

In embodiments of the invention, the beverage storage cabinet 100 may include a controller that may enhance and vary the infinity effect. In at least one embodiment, the beverage storage cabinet may include or hold one or more of a humidity control unit and a temperature control unit.

Figure 4:
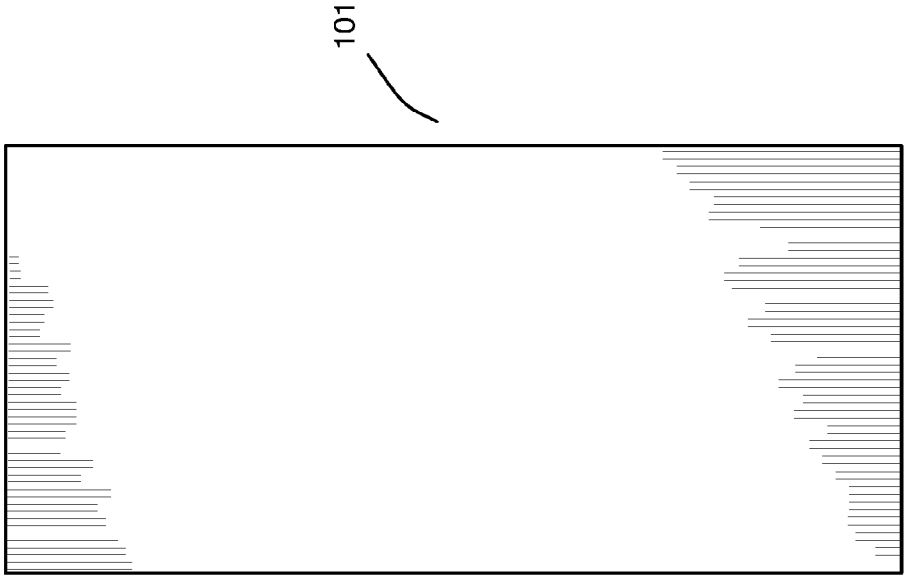
FIG. 4 shows a back view of the beverage storage cabinet according to one or more embodiments of the invention.
Figure 3:
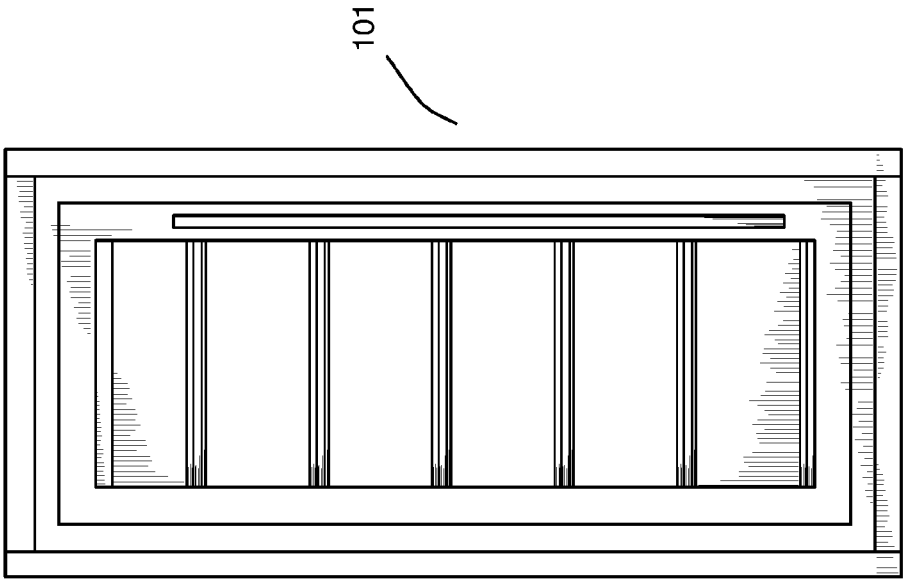
FIG. 3 shows a front view of the beverage storage cabinet according to one or more embodiments of the invention.

FIG. 3 shows a front view of the beverage storage cabinet according to one or more embodiments of the invention, and FIG. 4 shows a back view of the beverage storage cabinet according to one or more embodiments of the invention.

Figure 5:
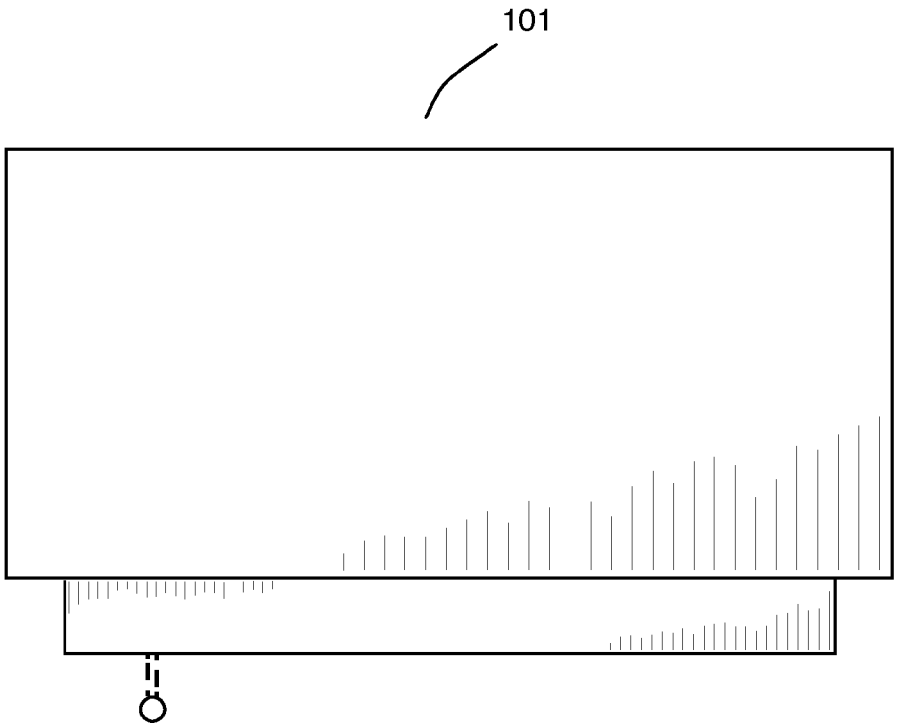
FIG. 5 shows a bottom view of the beverage storage cabinet according to one or more embodiments of the invention.
Figure 6:
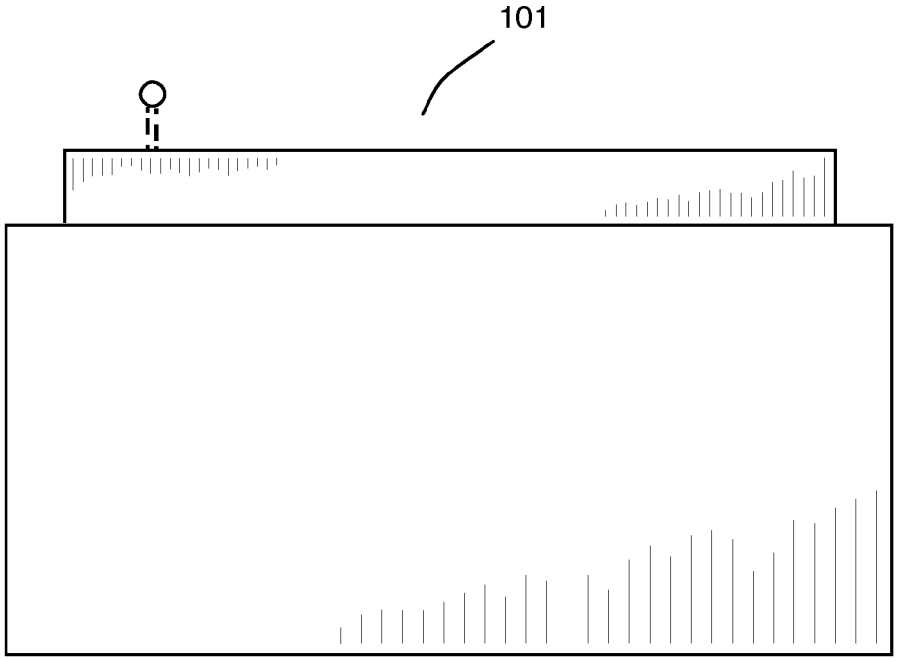
FIG. 6 shows a top view of the beverage storage cabinet according to one or more embodiments of the invention.

FIG. 5 shows a bottom view of the beverage storage cabinet according to one or more embodiments of the invention, and FIG. 6 shows a top view of the beverage storage cabinet according to one or more embodiments of the invention.

Figure 8:
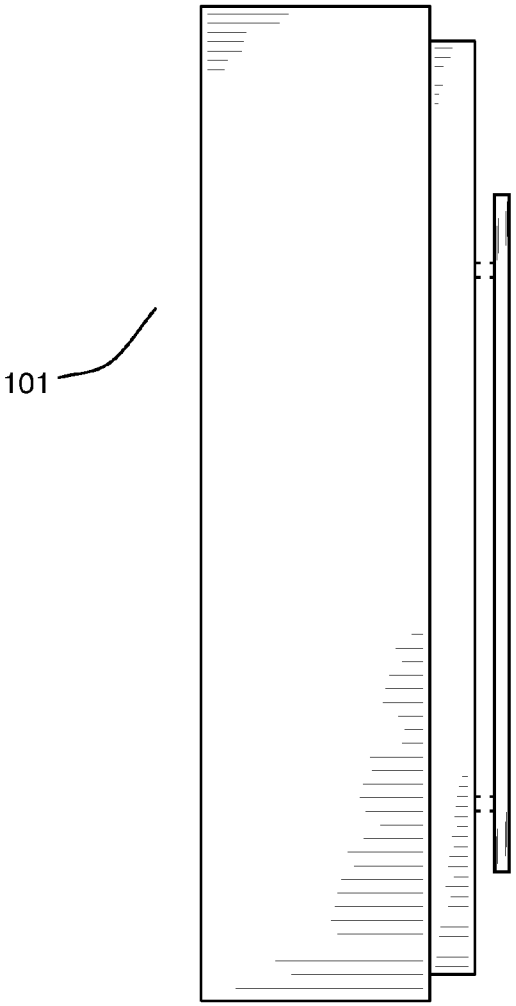
FIG. 8 shows a left view of the beverage storage cabinet according to one or more embodiments of the invention.
Figure 7:
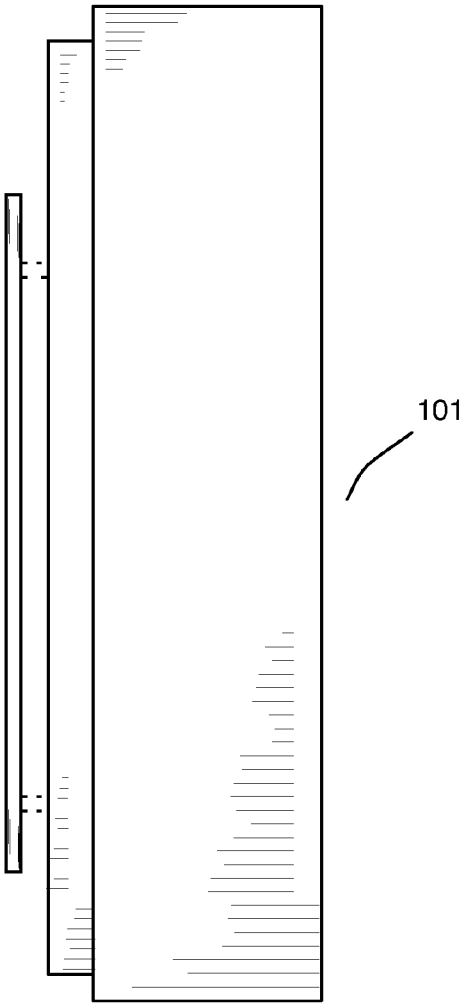
FIG. 7 shows a right view of the beverage storage cabinet according to one or more embodiments of the invention.

FIG. 7 shows a right view of the beverage storage cabinet according to one or more embodiments of the invention, and FIG. 8 shows a left view of the beverage storage cabinet according to one or more embodiments of the invention.

In at least one embodiment, the front wall surface one-way mirror, the back wall surface full mirror (shown in FIG. 10 and discussed below) and the option sidewall surface full mirrors may include a full gloss surface or light boxes in addition to or alternatively to a mirror. In embodiments of the invention, the enclosure 101 may include internal enclosure lights internal to the enclosure 101 on each of the two sidewall surfaces 103*a* and 103*b*. By way of one or more embodiments, the beverage storage cabinet 100 may include a light sensor that may be coupled with the controller to adjust the internal enclosure lights to enhance and vary the infinity effect. In one or more embodiments, the beverage storage cabinet 100 may include a dimmer that may couple with the controller and the light sensor. In at least one embodiment, the controller may adjust the internal enclosure lights by one or more of brightening/dimming the internal enclosure lights via the dimmer which may be implemented with any component that may vary the intensity of the internal lighting up or down, brighter or dimmer, if an ambient light exterior to the enclosure 101 is bright/dim, for example to keep the internal light intensity greater than the external light intensity to produce and/or ensure the infinity effect.

According to one or more embodiments, when an ambient light is darker than the interior lighting of the beverage storage container 100, the one-way mirror (shown in FIG. 11 and discussed below) may show little or no reflection of a viewer that may be standing outside the beverage storage container 100. As such, in embodiments of the invention, if a viewer is standing outside and looking inside the beverage storage container 100, the viewer may see the interior of the beverage storage container 100 clearly with no reflection of oneself.

According to one or more embodiments, the one-way mirror (shown in FIG. 11 and discussed below) may include an electronic one-way mirror coupled with the controller. In embodiments of the invention, the dimmer and light sensor may be coupled with the controller and the electronic one-way mirror. In at least one embodiment, the electronic one-way mirror may include at least one light coupled with the light sensor, such that the controller may enhance and vary the infinity effect on the electronic one-way mirror by adjusting the at least one light by one or more of brightening/dimming the at least one light via the dimmer to keep the internal light intensity greater than the external light intensity to produce and/or ensure the infinity effect.

In one or more embodiments, as long as the ambient light exterior to the beverage storage container 100 is dimmer than the interior lighting inside the enclosure 101, the infinity effect may be visible. As such, due to the adjustable interior lighting within the enclosure 101, the beverage storage cabinet 100 may be used in a plurality of environments.

By way of at least one embodiment, the beverage storage cabinet 100 may include one or more of a power cord, a plug and a lock, such as a door lock (shown in FIG. 9 and discussed below). In one or more embodiments, the lock may couple at least one side of the front wall surface 102, or the at least one air-tight front door 106, to one of the at least two sidewall surfaces 103*a* and 103*b* and/or top and/or bottom surfaces depending on the desired implementation. In at least one embodiment, the beverage storage cabinet 100 may include at least one hinge that may be concealed (shown in FIG. 12 and discussed below), such that the at least one front door 106 may couple with at least one of the at least two sidewall surfaces 103*a* and 103*b* via the at least one hinge. In at least one embodiment, the at least one front door 106 may couple with an area proximal to the top 104*a* or bottom 104*b* via the at least one hinge.

In one or more embodiments of the invention, the beverage storage cabinet 100 may include at least one sliding coupling element, such that the at least one front door 106 may couple with an area proximal to the top 104*a* or bottom 104*b* or both the top 104*a* and bottom 104*b* via the at least one sliding coupling element, to enable the door or doors to slide open if desired. In embodiments of the invention, the beverage storage cabinet 100 may include one or more of a temperature recording device and a humidity recording device, see also FIG. 10.

Figure 9:
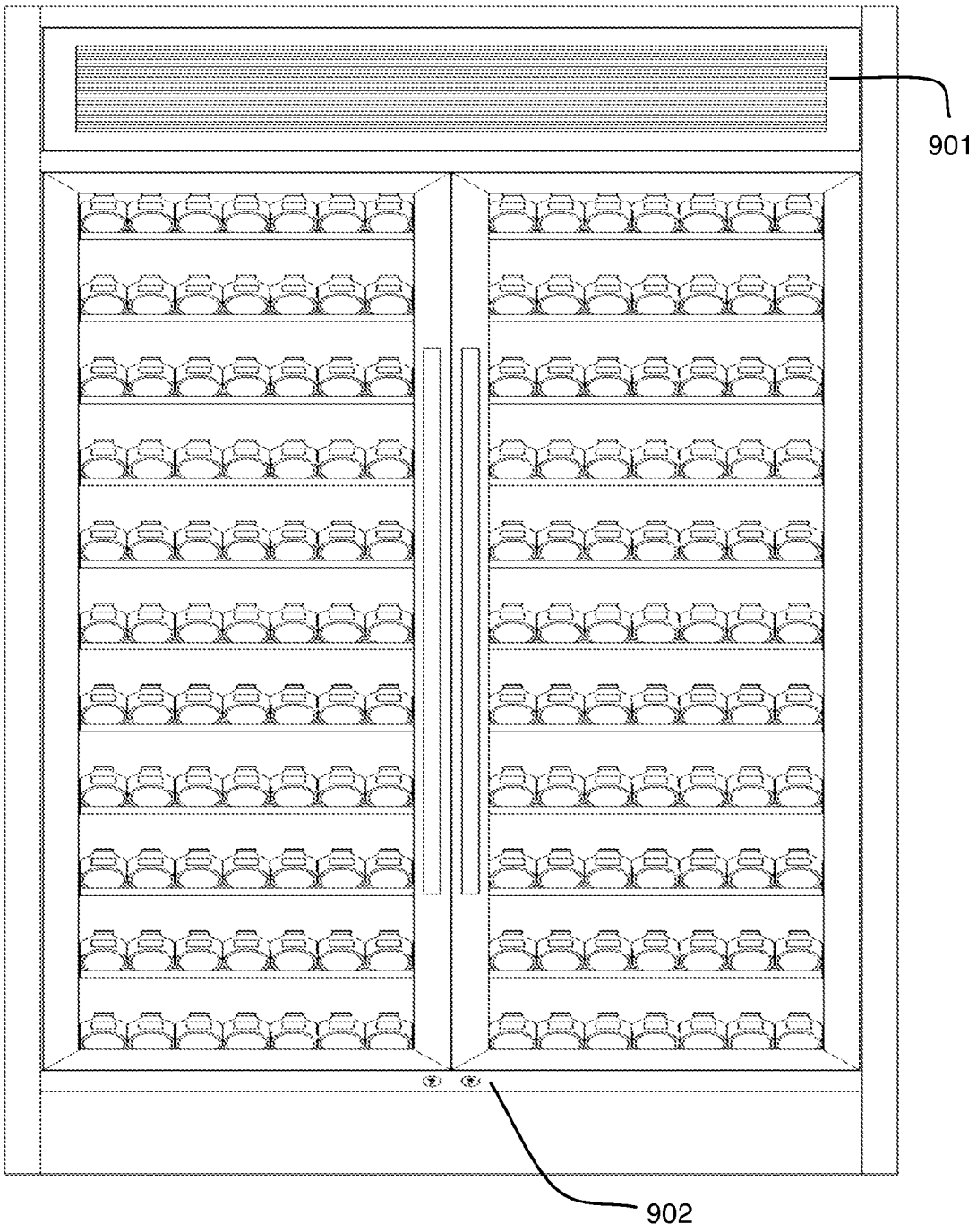
FIG. 9 shows a front elevation view of the beverage storage cabinet having two doors according to one or more embodiments of the invention.

FIG. 9 shows a front elevation view of the beverage storage cabinet according to one or more embodiments of the invention. As shown in FIG. 9, the beverage storage cabinet 100 may include one or more of a cooling unit (shown in FIG. 10 and discussed below), a louvered service hatch of the cooling unit 901, and one or more door locks 902. The cooling unit, in at least one embodiment, may be located at a top portion of the beverage storage cabinet 100, interior to or exterior to the enclosure 101.

Figure 10:
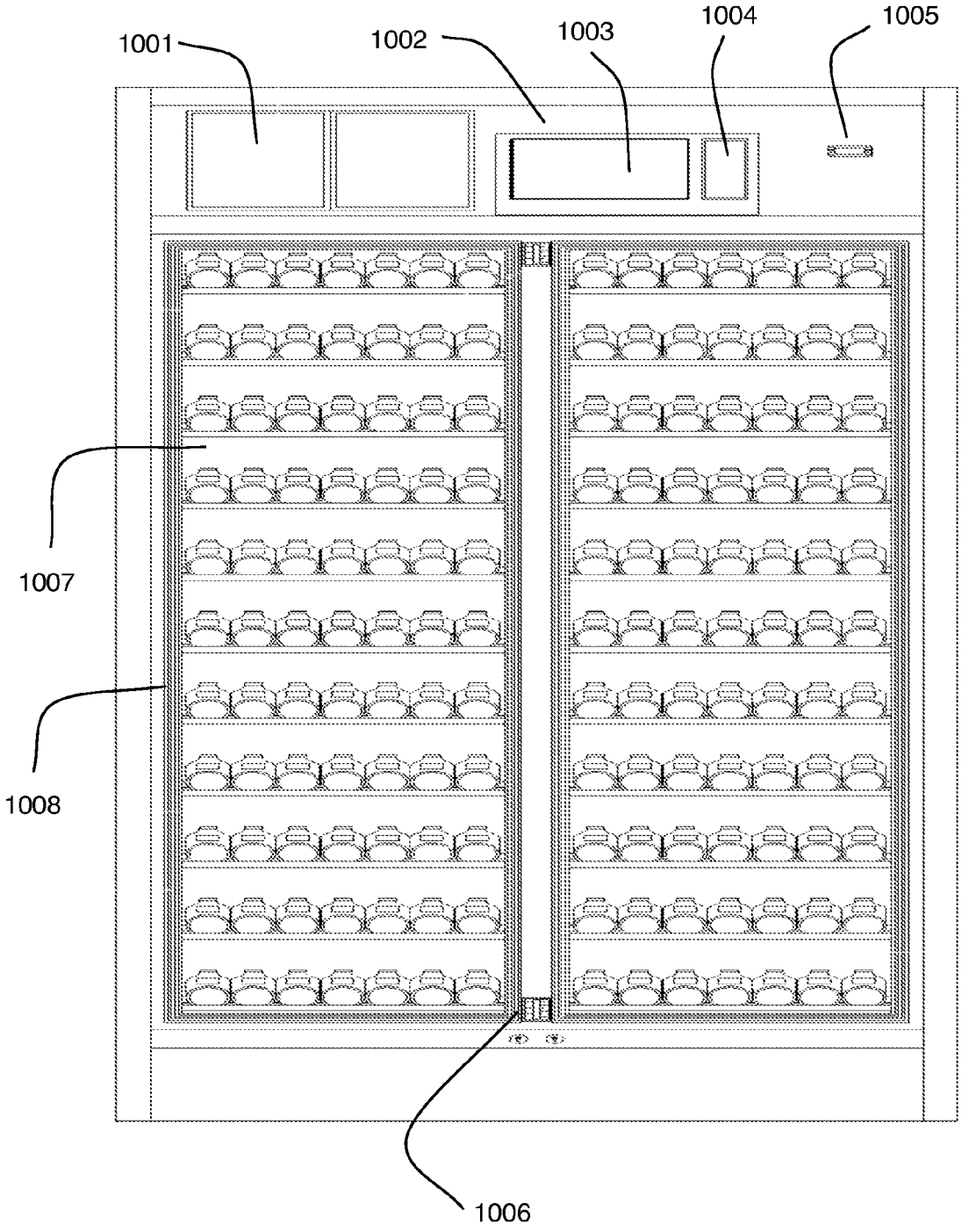
FIG. 10 shows a front interior elevation view of the beverage storage cabinet according to one or more embodiments of the invention.

FIG. 10 shows a front interior elevation view of the beverage storage cabinet according to one or more embodiments of the invention. As shown in FIG. 10, the beverage storage container 100 or enclosure 101 may include a cooling unit 1002, a cooling unit digital controller (not shown for brevity, but which may be located within the cooling unit or external to the cooling unit as long as it is coupled to the cooling unit and capable of controlling the cooling unit), a cooling unit condenser (not shown but may in some embodiments be located on the back side of the cooling unit), an electrical power panel for the cooling unit and at least one LED light 1001 (shown in FIG. 11 and discussed below), an air inlet of the cooling unit's condenser 1003 and an air outlet of the cooling unit's condenser 1004. In one or more embodiments, the beverage storage cabinet 100 or enclosure 101 may include a remote display of the cooling unit's digital controller 1005, wherein the controller may be integrated on the rear portion of the display. In embodiments of the invention, the beverage storage cabinet 100 or enclosure 101 may include one or more of at least one door gasket 1008 and at least one magnet 1006. In embodiments of the invention, the at least one magnet 1006 may keep the at least one front door 106 tightly closed, and may simultaneously apply pressure on the at least one door gasket 1008 for stronger and tighter sealing. In one or more embodiments, the back wall surface 105 may include a full mirror 1007 facing the front wall surface 102, that creates the infinity effect by bouncing light between the mirror 1007 at the back of the cabinet and the one-way mirror on the front wall surface for example. In one or more embodiments, the system may include a temperature recording device and/or a humidity recording device for example coupled with controller 1005 and mounted internal to the cabinet, and/or a remote electronic monitoring system for example coupled with the temperature and/or humidity sensors/recording device that measures the ambient temperature and humidity inside the cellar, and of the air as taken in by the condenser of the AC unit and the air blown back into the cabinet by the evaporator of the AC. The remote electronic monitory system may be implemented with a communication element that is coupled to or internal to or in any other manner connected with controller 1005 as one skilled in the art will recognize. When the results are outside the previously set values, for example as stored in the memory of controller 1005, a message may be sent to the manufacturer via a communication message, for example an IP message, whether wired or wireless, or any other type of message including an SMS, GSM, Internet message or using standard phone lines. The message may be sent to any accessible location or device type. The manufacturer and/or owner of the cabinet may use the data for diagnostic and determines how to respond.

Figure 11:
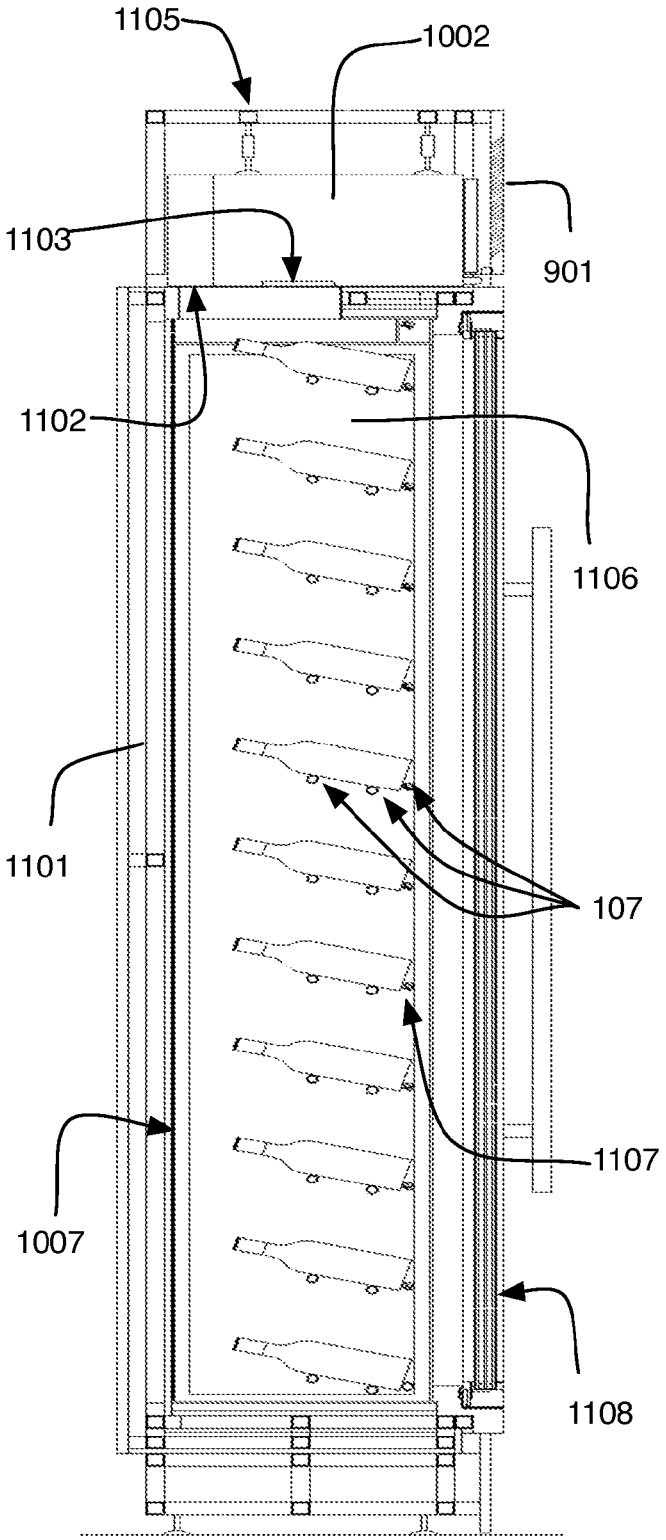
FIG. 11 shows a sectional view of the beverage storage cabinet according to one or more embodiments of the invention.

FIG. 11 shows a sectional view of the beverage storage cabinet according to one or more embodiments of the invention. As shown in FIG. 11, embodiments of the invention may include one or more of a metal structure 1101 supporting the beverage storage container 100, cooling unit 1002, louvered service hatch of the cooling unit 901, a cooling unit evaporator (not shown), an air inlet of cooling unit's evaporator 1102, an air outlet of cooling unit's evaporator 1103, the back wall surface full mirror 1007 and a fixing bolt for the cooling unit 1105. In at least one embodiment, as shown in FIG. 11, the beverage storage cabinet 100 or enclosure 101 may include one or more of at least one storage support bar 107, a light box 1106, and at least one storage support bar light element 1107 and a front wall surface one-way mirror 1108. In one or more embodiments, the one-way mirror 1108 may be glass coated with, or may be encased in, a thin and fully transparent or semi-transparent layer of metal. As such, in embodiments of the invention, the one-way mirror 1108 may result in reflection of some light and may be penetrated by the rest of the light.

In at least one embodiment, the at least one light element 1107 may include at least one LED light strip (RGB) that may be coupled to or integrated with the light box 1106. In embodiments of the invention, the beverage storage cabinet 100 or the enclosure 101 may include at least one power cable for the at least one LED light strip. In one or more embodiments, the at least one light element 1107 may individually light each beverage container on each of the at least one support bar 107. In embodiments, the light box 1106 may include one or more of at least one support for the light box, at least one light diffusing acrylic sheet, at least one clear acrylic sheet supporting the at least one storage support bar 107, and a frosted acrylic sheet.

According to embodiments of the invention, the one-way mirror 1108 may be integrated in the layered thermal glass and may be tempered. In at least one embodiment, the layered thermal glass may include a first layer of tempered glass, a second layer of tempered glass that may be covered with UV-filtering film, and the tempered one-way mirror 1108 in between the first layer of tempered glass and the second layer of tempered glass.

Figure 12:
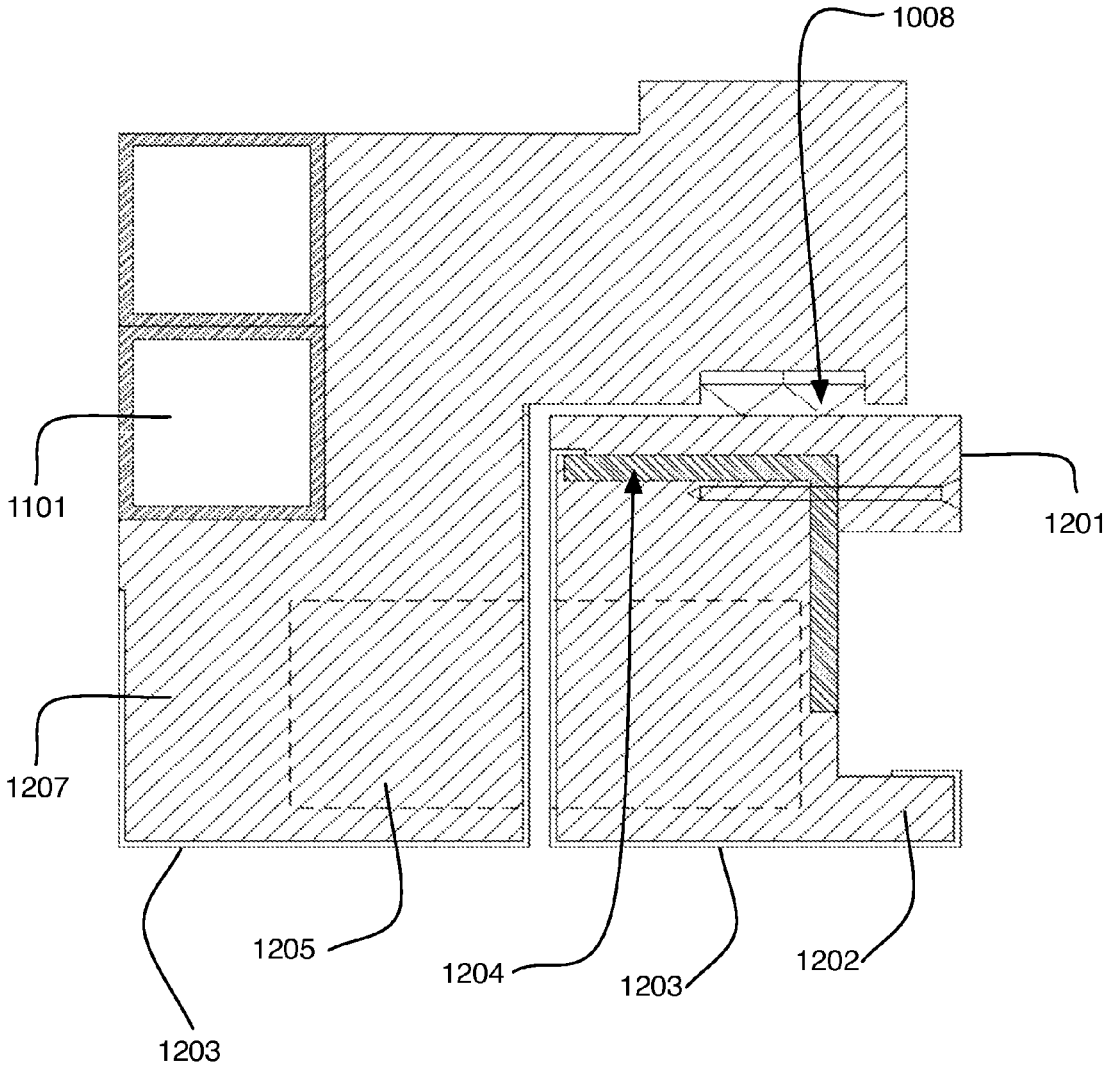
FIG. 12 shows a side detailed view of a section of the beverage storage cabinet according to one or more embodiments of the invention.

FIG. 12 shows a side detailed view of a section of the beverage storage cabinet according to one or more embodiments of the invention. As shown in FIG. 12, in at least one embodiment, the beverage storage cabinet 100 or enclosure 101 may include one or more of a metal structure 1101 supporting the beverage storage cabinet 100, at least one door gasket 1008, at least one glazing bead 1201, at least one wooden door stile or rail 1202, at least one bended metal sheet or at least one wood veneer 1203 that may be a decorative finish 1203. In one or more embodiments, the beverage storage cabinet 100 or enclosure 101 may include at least one angle steel 1204 supporting the at least one wooden door stile or rail 1202, at least one door hinge 1205 that may be concealed, and at least one wooden door frame 1207. In embodiments of the invention, the at least one door hinge 1205 may be made of wood and the at least one wooden door frame 1207 may be made of solid wood, such that when coupled the beverage storage cabinet 100 may be tightly secured and fine-tuned during opening and closing of the at least one front door 106.

Figure 13:
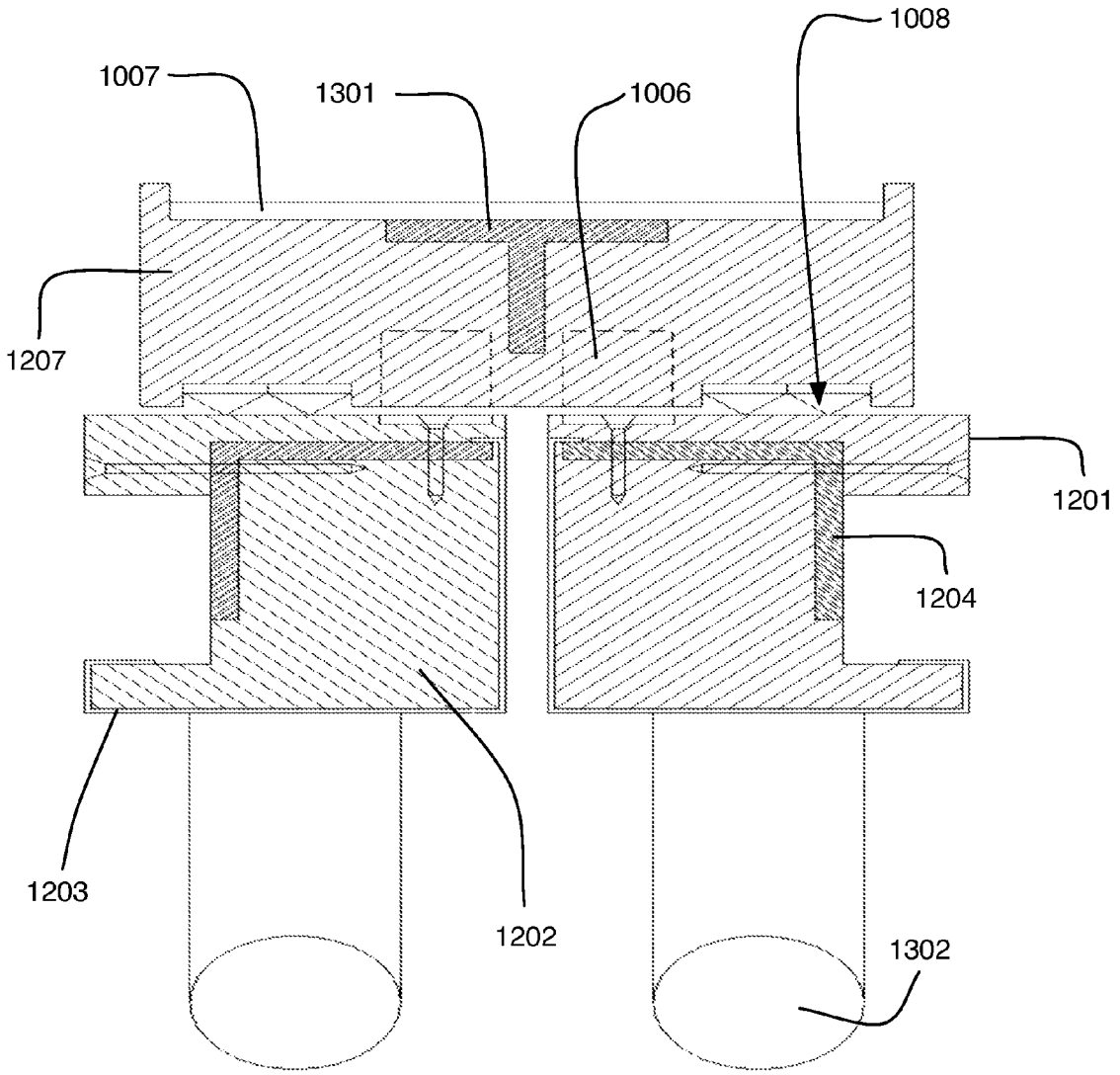
FIG. 13 shows a front detailed view of a section of the beverage storage cabinet according to one or more embodiments of the invention.

FIG. 13 shows a front detailed view of a section of the beverage storage cabinet according to one or more embodiments of the invention. As shown in FIG. 13, according to at least one embodiment, the beverage storage cabinet 100 or enclosure 101 may include the at least one glazing bead 1201, the at least one door gasket 1008, the at least one wooden door frame 1207, the at least one magnet 1006, the full mirror 1007, the at least one wooden door stile or rail 1202, the at least one bended metal sheet or at least one wood veneer as a decorative finish 1203, the at least one angle steel 1204 supporting the at least one wooden door stile or rail 1202. In at least one embodiment, the beverage storage cabinet 100 or enclosure 101 may include at least one T-steel support 1301 and at least one pull handle 1302.

In one or more embodiments of the invention, the beverage storage container 100 may include one or more of a cabinet shell on an exterior portion of the beverage storage container 100, exterior to the enclosure 101, and a thermal insulation with a vapor barrier. In at least one embodiment, the thermal insulation may be located between the cabinet shell and the metal structure 1101. By way of one or more embodiments, the enclosure 101 may include at least one spacer placed alone said at least one support bar 107, and/or in between two of said at least one support bar 107, such that beverage containers may only be located on said at least one support bar 107 to the side(s) of said at least one spacer. In at least one embodiment, each of the at least one spacer may include a three-dimensionally shaped solid component that may include one or more of a metal, a plastic, any combination thereof or any other material well known to those of ordinary skill in the art within the scope of the invention. In embodiments of the invention, the at least one spacer may be rectangular, circular, or any other shape well known to those of ordinary skill in the art within the scope of the invention. By way of one or more embodiment, the at least one spacer may provide clearance for air circulation within the enclosure 101.

While the invention herein disclosed has been described by means of specific embodiments and applications thereof, numerous modifications and variations could be made thereto by those skilled in the art without departing from the scope of the invention set forth in the claims.

What is claimed is:

1. A beverage storage cabinet comprising:

an enclosure comprising a front wall surface comprising at least one air-tight front door, wherein said at least one air-tight front door comprises layered thermal glass, at least one storage support bar, wherein said at least one storage support bar is configured to support at least one beverage container, and wherein said at least one support bar comprises at least one light element;

two sidewall surfaces opposite of one another, a top and a bottom opposite of one another, and a back wall surface opposite of said front wall surface, wherein said back wall surface couples to both of said two sidewall surfaces along vertical axes, wherein said back wall surface and said two sidewall surfaces couple with said top and bottom and wherein said at least one air-tight front door is configured to enclose an inner portion of said enclosure;

wherein said two sidewall surfaces each comprise a light box or full mirror opposing one another, wherein said front wall surface further comprises a one-way mirror, wherein said back wall surface comprises a full mirror facing said front wall surface, and wherein said enclosure is configured to present an infinity effect reflection of a repeated succession of items that appear to recede rearward behind said back wall surface.

2. The beverage storage cabinet according to claim 1, wherein said at least one light element comprises at least one LED light strip.

3. The beverage storage cabinet according to claim 1, wherein said one-way mirror is integrated in said layered thermal glass.

4. The beverage storage cabinet according to claim 1, wherein said enclosure is configured to hold a humidity control unit.

5. The beverage storage cabinet according to claim 1, wherein said enclosure is configured to hold a temperature control unit.

6. The beverage storage cabinet according to claim 1, wherein said enclosure further comprises internal enclosure lights internal to said enclosure on each of said two sidewall surfaces.

7. The beverage storage cabinet according to claim 1, further comprising a controller configured to enhance and vary said infinity effect.

8. The beverage storage cabinet according to claim 7, further comprising internal enclosure lights and a light sensor coupled with said controller that is configured to adjust said internal enclosure lights to enhance and vary said infinity effect.

9. The beverage storage cabinet according to claim 8, further comprising a dimmer coupled with said controller and said light sensor.

10. The beverage storage cabinet according to claim 9, wherein said controller is further configured to adjust said internal enclosure lights by one or more of brightening or dimming said internal enclosure lights via said dimmer to keep internal light intensity higher than external light intensity to ensure said infinity effect.

11. The beverage storage cabinet according to claim 7, wherein said one-way mirror comprises an electronic one-way mirror coupled with said controller.

12. The beverage storage cabinet according to claim 11, further comprising a dimmer and a light sensor coupled with said controller and said electronic one-way mirror, wherein said electronic one-way mirror comprises at least one light coupled with said light sensor, and wherein said controller is further configured to enhance and vary said infinity effect on said electronic one-way mirror by adjusting said at least one light by one or more of brightening or dimming said at least one light via said dimmer to keep internal light intensity higher than external light intensity to ensure said infinity effect.

13. The beverage storage cabinet according to claim 7, further comprising a communication element coupled with the controller and configured to send a message remotely if a humidity or temperature range is exceeded.

14. The beverage storage cabinet according to claim 1, further comprising a power cord and a plug.

15. The beverage storage cabinet according to claim 14, further comprising at least one hinge wherein said front door couples with an area proximal to said top or bottom via said at least one hinge.

16. The beverage storage cabinet according to claim 1, further comprising a lock that couples at least one side of said front door to one of said two sidewall surfaces or said top or said bottom or any combination thereof.

17. The beverage storage cabinet according to claim 1, further comprising at least one hinge wherein said front door couples with at least one of said two sidewall surfaces via said at least one hinge.

18. The beverage storage cabinet according to claim 1, further comprising at least one sliding coupling element wherein said front door couples with an area proximal to said top or bottom or both said top and bottom via said at least one sliding coupling element.

19. The beverage storage cabinet according to claim 1, further comprising a temperature recording device.

20. The beverage storage cabinet according to claim 1, further comprising a humidity recording device.

* * * * *